US005085195A

United States Patent [19]

Yoshizu

[11] Patent Number: 5,085,195

[45] Date of Patent: Feb. 4, 1992

[54] INJECTION TIMING CONTROL DEVICE FOR DISTRIBUTOR-TYPE FUEL INJECTION PUMPS

[75] Inventor: Fumitsugu Yoshizu, Higashimatsuyama, Japan

[73] Assignee: Diesel Kiki Co., Ltd., Tokyo, Japan

[21] Appl. No.: 551,940

[22] Filed: Jul. 12, 1990

[30] Foreign Application Priority Data

Jul. 20, 1989 [JP] Japan ..... 1-85367[U]

[51] Int. Cl.[5] ..... F02M 41/00

[52] U.S. Cl. ..... 123/502; 123/449

[58] Field of Search ..... 123/502, 449, 179 L

[56] References Cited

U.S. PATENT DOCUMENTS

| | | | |
|---|---|---|---|
| 4,262,645 | 4/1981 | Koboyashi et al. | 123/502 |
| 4,316,441 | 2/1982 | Sakuranaka | 123/502 |
| 4,333,437 | 6/1983 | Lohner | 123/502 |
| 4,478,195 | 10/1984 | Dorenkamp | 123/502 |
| 4,501,252 | 2/1985 | Stumpp et al. | 123/502 |
| 4,753,211 | 6/1988 | Hofer | 123/449 |

FOREIGN PATENT DOCUMENTS

| | | | |
|---|---|---|---|
| 1094527 | 12/1960 | Fed. Rep. of Germany | 123/502 |
| 58-5437 | 1/1983 | Japan . | |

*Primary Examiner*—E. Rollins Cross
*Assistant Examiner*—Erick Solis
*Attorney, Agent, or Firm*—Frishauf, Holtz, Goodman & Woodward

[57] ABSTRACT

An injection timing control device for a distributor-type fuel injection pump, has a timer piston slidable within a cylinder in response to a difference between pump chamber pressure and the force of a timer spring to thereby rotate a roller holder for varying the fuel injection timing. A movable seat member is urged by a second spring toward the timer piston, and has one end thereof disposed for urging contact with one end face of the timer piston, which has a total effective pressure receiving area at which the pump chamber pressure acts on upon the timer piston. The total effective pressure receiving area is decreased while the seat member abuts against the one end face of the timer piston. A stopper allows the seat member to be moved by the force of the second spring toward the timer piston with the one end kept in urging contact with the one end face of the timer piston while the timer piston moves from a first position, in which the fuel injection timing is most retarded, to a second position, in which the fuel injection timing is advanced by a predetermined amount, and inhibits the seat member from being moved by the force of the second spring toward the timer piston to bring the one end out of contact with the one end face of the timer piston after the timer piston is moved beyond the second position in the timing advancing direction.

11 Claims, 3 Drawing Sheets

INJECTION TIMING CONTROL DEVICE FOR DISTRIBUTOR-TYPE FUEL INJECTION PUMPS

BACKGROUND OF THE INVENTION

This invention relates to an injection timing control device for distributor-type fuel injection pumps for use in internal combustion engines such as diesel engines, and more particularly to a device of this kind which is adapted to control the fuel injection timing in response to the rotational speed of the engine.

In order to meet requirements imposed by legal regulations concerning exhaust emissions as well as demand for reducing combustion noise during low rotational speed operation, etc. of diesel engines, it has recently been required that injection timing devices for distributor type fuel injection pumps should be designed to vary the fuel injection timing characteristic with respect to the rotational speed of the pump between a lower rotational speed range and a higher rotational speed range.

An injection timing control device of this kind, which is designed to vary the fuel injection timing characteristic as required above, has been proposed e.g. by Japanese Provisional Patent Publication (Kokai) No. 58-5437. This proposed device includes a roller holder, a cylinder forming the housing of the device, and a timer piston slidably received within the cylinder to move the roller holder, the piston defining at opposite ends thereof a hydraulic pressure chamber and a timer spring chamber within the cylinder. The timer piston is displaced by fuel pressure introduced into the hydraulic pressure chamber and variable in proportion to the rotational speed of the engine, thereby varying the circumferential position of the roller holder and hence the fuel injection timing.

According to the proposed device, the timer piston has an end thereof formed with a stepped surface having one or more steps. The cylinder also has an opposed end thereof formed with a stepped surface corresponding in shape to, and adapted to mate with the stepped surface of the timer piston. With such arrangement, when the rotational speed of the engine is in a low range below a predetermined value, the stepped surface of the timer piston is kept mated with the stepped surface of the cylinder, whereby the pressure receiving area of the end of the timer piston is relatively small. On the other hand, when the rotational speed is in a high range above the predetermined value, the timer piston is displaced away from the cylinder to have the stepped surfaces disengaged from each other, whereby the above pressure receiving area increases.

However, in the proposed device, it is required to machine with close tolerances not only the opposed inner and outer peripheral surfaces of the timer cylinder and the piston but also the stepped surfaces of the timer piston and the cylinder, in order to improve the oiltightness and slidability therebetween. Thus, the proposed device had the disadvantage that much labor and time is required to machine two places of the injection timing device with sufficient accuracy.

SUMMARY OF THE INVENTION

It is the object of the invention to provide an injection timing control device for distributor-type fuel injection pumps, which can provide different fuel injection timing characteristics between a lower rotational speed range and a higher one, but is easy to manufacture, particularly because the timer piston and the cylinder require simple machining.

In order to attain the above object, the present invention provides an injection timing control device for a distributor-type fuel injection pump having a pump housing defining therein a pump chamber, a cylinder provided on the pump housing, a timer piston slidably received within the cylinder, a roller holder connected to the timer piston, means for applying pressure within the pump chamber to the timer piston at one end face within the cylinder, first spring means urging the timer piston at another end face against the pressure, and wherein the timer piston is slidably moved within the cylinder in response to a difference between the pressure and the force of the first spring means to thereby rotate the roller holder for varying the fuel injection timing.

The injection timing control device according to the present invention is characterized by an improvement comprising:

a seat member being movable and having one end thereof disposed for urging contact with the one end face of the timer piston, the one end face of the timer piston having a total effective pressure receiving area at which the pressure acts on upon the timer piston, the total effective pressure receiving area being decreased when the one end of the seat member is in urging contact with the one end face of the timer piston;

second spring means urging the seat member toward the timer piston; and stopper means associated with the seat member and operable to allow the seat member to be moved by the force of the second spring means toward the timer piston to have the one end thereof kept in urging contact with the one end face of the timer piston while the timer piston moves from a first position, in which the fuel injection timing is most retarded, to a second position, in which the fuel injection timing is advanced by a predetermined amount, and inhibit the seat member from being moved by the force of the second spring means toward the timer piston to bring the one end thereof out of contact with the one end face of the timer piston after the timer piston is moved beyond the second position in a direction of further advancing the fuel injection timing.

Preferably, the one end face of the timer piston comprises a flat central pressure-receiving surface, and a slant peripheral pressure receiving surface, the seat member comprising a cylindrical member having one end thereof disposed for urging contact with the slant peripheral pressure-receiving surface of the timer piston.

More preferably, the device includes an annular seal member secured to the one end of the seat member for urging contact with the slant peripheral pressure-receiving surface of the timer piston.

The annular seal member is secured by baking to an inner peripheral edge of the one end of the seat member.

The device includes a passage having a restriction formed through the timer piston and communicating a space defined between the cylinder, the slant peripheral pressure-receiving surface, and the one end of the seat member with a low pressure zone.

The stopper means comprises a flanged portion formed on the seat member, and an annular stopper arranged at a predetermined location between the flanged portion and the timer piston, the flanged portion being disposed to abut against the annular stopper while the seat member is moved toward the timer piston.

The annular stopper may comprise a shim.

The above and other objects, features, and advantages of the invention will be more apparent from the ensuing detailed description taken in conjunction with the accompanying drawings.

DETAILED DESCRIPTION

The invention will now be described in detail with reference to the drawings showing an embodiment thereof.

Figure 1:
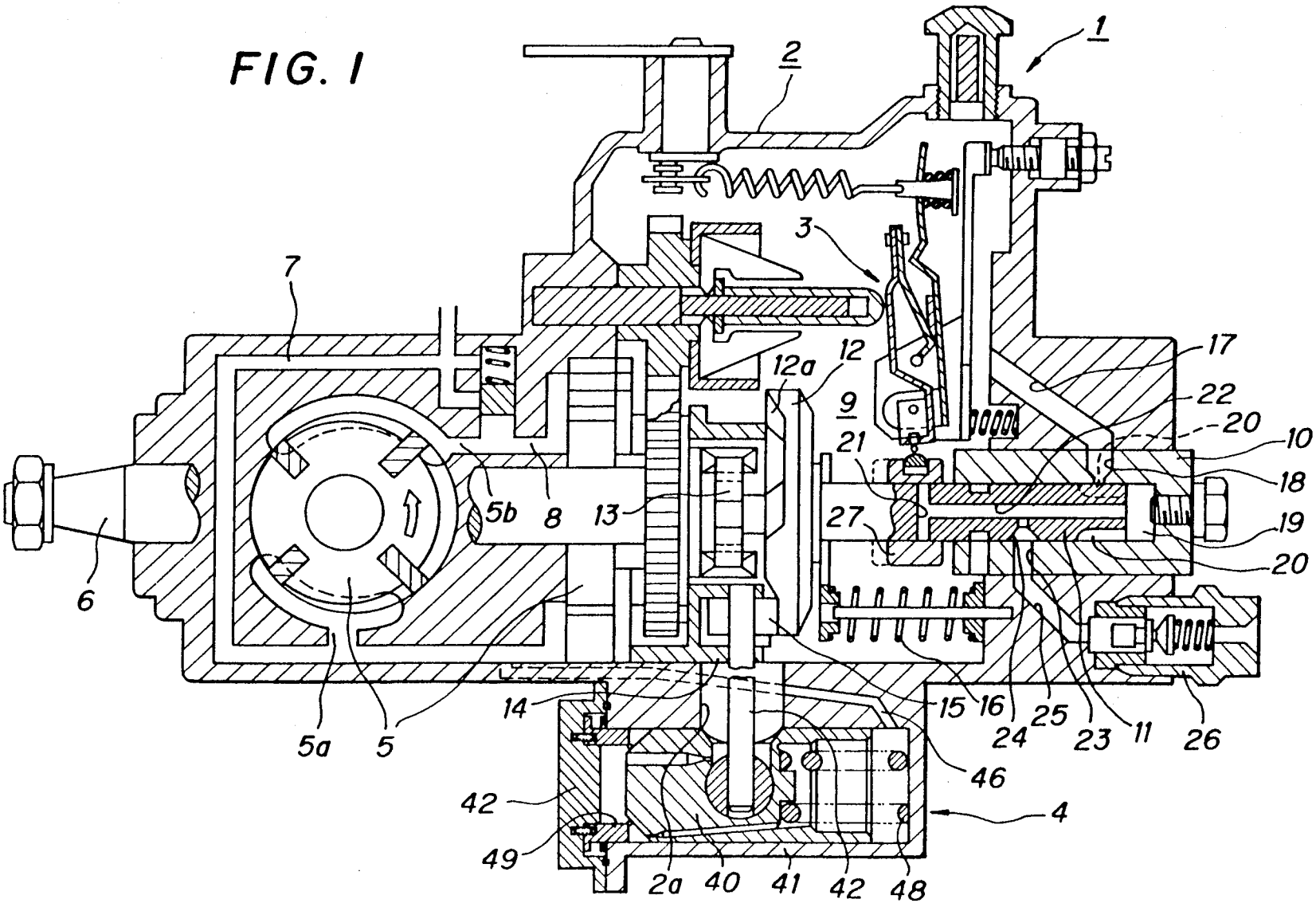
FIG. 1 is a sectional view of a distributor-type fuel injection pump which employs an injection timing control device according to an embodiment of the present invention.

Referring first to FIG. 1, there is illustrated a fuel injection pump of distributor type equipped with an injection timing control device according to the invention. The distributor-type fuel injection pump 1 has a pump housing 2 in which a mechanical governor 3 is incorporated to control the delivery fuel quantity or capacity of the fuel injection pump 1. An injection timing control device (hereinafter referred to merely as "the timer") 4 is arranged on the lower wall of the pump housing 2. Incidentally, in FIG. 1, the timer 4 as well as a fuel feed pump 5 are illustrated in transverse cross section, i.e. taken along a line different by 90 degrees to the other components and parts, for better understanding.

A drive shaft 6 extends axially of the pump housing 2, with one end portion thereof projecting out of the pump housing 2 to be driven by an internal combustion engine or diesel engine, not shown, and an intermediate portion thereof to which the fuel feed pump 5 is coupled. The fuel feed pump 5 is supplied with fuel from a fuel tank, not shown, through an oil passage 7 and a suction port 5*a* under low pressure in the pump housing 2, pressurizes the supplied fuel, and then delivers the pressurized fuel into a pump chamber 9 defined within the pump housing 2 through a discharge port 5*b* and a delivery passage 8.

A plunger 11 is slidably received in a plunger barrel 10 secured to the pump housing 2. The plunger 11 has a base end thereof provided with a cam disc 12 coupled to the other end portion of the drive shaft 6 in a manner being axially movable relative thereto but rotatable together therewith by means of a coupling 13. The cam disc 12 has a camming surface 12*a* thereof formed with highs equal in number to the number of the cylinders of the engine. The cam disc 12 is urged by a plunger spring 16 in a direction away from the plunger 11, to always keep the camming surface 12*a* in slidable contact with rollers 15 rotatably supported by a roller holder 14. While the cam disc 12 is rotated with rotation of the drive shaft 6 by one turn, the plunger 11 is caused to reciprocate the number of times equal to the number of the engine cylinders.

One end of the drive shaft 6 remote from the cam disc 12 has an outer peripheral surface thereof formed with a plurality of oil introducing slits 20 circumferentially equally spaced and equal in number to the number of the engine cylinders so that as the plunger 11 is moved leftward as viewed in FIG. 1 during the suction stroke, fuel is introduced from the pump chamber 9 into a plunger chamber 19 defined by the plunger 11 within the cylinder barrel 10, through an oil passage 17 formed in the pump housing 2, an oil passage 18 formed through the peripheral wall of the cylinder barrel 10, and each axial slit 20, in the mentioned order. The plunger 11 has an axial hole 22 formed along an axis thereof and having an open end thereof opening into the plunger chamber 19 and the other end thereof disposed to communicate with the pump chamber 9 via a cutoff port 21 radially formed in the plunger 11 in communication with the axial hole 22. The plunger 11 also has a discharge port 24 radially formed at an intermediate portion thereof in communication with the axial passage 22. With such arrangement, as the plunger 11 is moved rightward as viewed in FIG. 1 during the pressurizing and delivering stroke, pressurized fuel within the plunger chamber 19 is delivered into one of delivery passages 23 formed through the plunger barrel 10 and equal in number to the number of the engine cylinders. The fuel supplied to the one delivery passage 23 is further delivered into an associated fuel injection valve, not shown, through a delivery passage 25, a delivery valve 26, and a fuel injection pipe, not shown, in the mentioned order.

A control sleeve 27 is slidably fitted on the plunger 11 at such a location that when the plunger 11 is moved rightward with rotation of the cam disc 12, the cutoff port 21 becomes disengaged from a rightward edge of the control sleeve 27, to be opened into the pump chamber 9, to allow fuel from the plunger chamber 19 to leak through the axial passage 22 and the cutoff port 21 into the pump chamber 9, thereby interrupting the fuel supply into the engine cylinder and hence terminating the delivery stroke. The control sleeve 27 is axially movable relative to the plunger 11 by the action of the mechanical governor 3 engaged therewith, to thereby control the fuel injection quantity.

Figure 2:
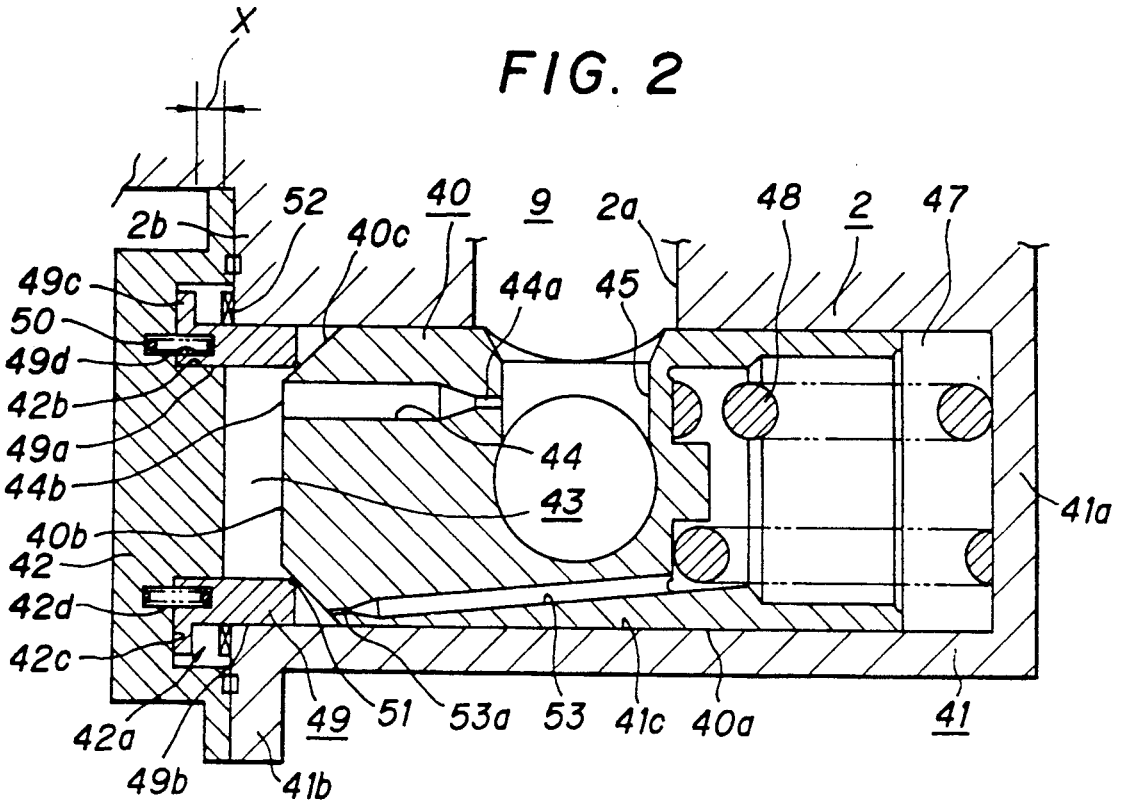
FIG. 2 is a longitudinal cross-sectional view of the injection timing control device of FIG. 1, which is in a position in which the pressure receiving area of the timer piston is relatively small.

As shown in FIGS. 1 and 2, the timer 4 comprises a cylinder 41 formed integrally with the lower wall of the pump housing 2, and a timer piston 40 axially slidably received within the cylinder 41. Alternatively, the cylinder 41 may be formed in a body separate from the pump housing 2, which is secured to the lower wall of the latter.

A hole 2*a* is formed through the lower wall of the pump housing 2 and opens into the pump chamber 9, through which a connecting rod 42 extends to connect between the timer piston 40 and the roller holder 14, such that, when the timer piston 40 moves rightward within the cylinder, as viewed in FIG. 2, the roller holder 14 is rotated to vary the phase of reciprocation of the plunger 11 relative to the rotation of the drive shaft 6 toward advanced fuel injection timing.

On the other hand, the cylinder 41 has an open end and an opposite end closed by a bottom wall 41*a*. The open end of the cylinder 41 is closed by a lid member 42 secured to a mounting wall 2*b* of the pump housing 2 and a flanged portion 41*b* of the cylinder 41, wherein a high pressure chamber 43 is defined between one end face of the timer piston 40 and the opposed face of the lid member 42. To supply pressure (pressurized fuel) into the high pressure chamber 43, the high pressure chamber 43 is communicated with the pump chamber 9 via a communication passage 44 with a restriction 44*a* formed in the timer piston 40, a cut-out 45 formed in the timer piston 40, and the hole 2*a* of the pump housing 2. The supplied pressure within the high pressure chamber 43 (hereinafter referred to merely as "the pump chamber pressure Pt") has such a characteristic that it promptly increases with increase in the rotational speed Np of the pump 5 before the latter reaches a first predetermined value N1 after the start of the engine, and thereafter moderately increases almost in proportion to increase in the pump rotational speed Np, as shown by the broken line in FIG. 4. A low pressure chamber 47 is defined between an inner end face of the bottom wall 41*a* of the cylinder 41 and the opposed end face of the timer piston 40, in communication with the suction port 5*a* of the fuel feed pump 5 via a communication passage 46 formed in the pump housing 2. A timer spring 48 formed by a coiled spring is disposed within the low pressure chamber 47, to urge the timer piston 40 toward the high pressure chamber 43.

Thus, the timer piston 40 slidably moves within the cylinder 41 in response to the difference between the pump chamber pressure Pt within the high pressure chamber 43 and the force of the timer spring 48. In order to ensure smooth sliding of the timer piston 40 within the cylinder 41 in an oiltight manner, the inner peripheral surface 41*c* of the cylinder 41 and the outer peripheral surface 40*a* of the timer piston 40 are both machined with close tolerances.

The timer piston 40 has one end face thereof defining the high pressure chamber 43 and formed with a flat central pressure-receiving surface 40*b*, and a slant annular peripheral pressure-receiving surface 40*c* which is so tapered as to decrease in diameter toward the central surface 40*b*. The communication passage 44 has an open end 44*b* thereof terminating in the central pressure-receiving surface 40*b*.

A cylindrical seat member 49 is slidably fitted in an annular groove 42*a* formed in the inner end face of the lid number 42 within the cylinder 41 in a manner projecting into the high pressure chamber 43. A second spring 50 has opposite ends thereof fitted in spring-receiving grooves 49*d*, 42*d* formed, respectively, in the cylindrical seat member 49 and the groove 42*a* of the lid member 42, to urge the cylindrical seat member 49 toward the timer piston 40. The cylindrical seat member 49 has a radially extending flanged portion 49*c* at one end thereof slidably fitted in the annular groove 42*a*, and a cylindrical portion projected into the cylinder 41. An annular seal member 51 is secured by baking to an inner peripheral end edge of the cylindrical seat member 49, which is close to the timer piston 40 in such a manner that the seal member 51 can be brought into liquidtight contact with the slant peripheral pressure-receiving surface 40*c* of the timer piston 40. The seal member 51 is formed of a resilient material, such as an O-ring. The seat member 49 has an inner peripheral surface 49*a* thereof in slidable contact with an inner peripheral surface 42*b* of the annular groove 42*a* of the lid member 42, and an outer peripheral surface 49*b* thereof in slidable contact with the inner peripheral surface 41*c* of the cylinder 41. The cylindrical seat member 49 is allowed to move by a predetermined amount X between two extreme positions, i.e. between a reference position (minimum advance position) (shown in FIG. 2) wherein the flanged portion 49*c* abuts against a bottom face 42*c* of the annular groove 42*a* of the lid member 42, and an advance position (shown in FIG. 3) wherein the flanged portion 49*c* of the seat member 49 abuts against an annular stopper 52 secured to the mounting wall 2*b* of the pump housing 2. The second spring 50, which urges the cylindrical seat member 49 toward the timer piston 40, may have only such a setting load that it causes the cylindrical seat member 49 to move into the advance position when the timer piston 40 is moved from a reference position (shown in FIG. 2) in a direction of advancing the fuel injection timing, which is by far smaller than the setting load of the timer spring 48.

The low pressure chamber 47 communicates with a space 43' defined between the slant peripheral pressure-receiving surface 40*c* and the opposed end face of the cylindrical seat member 49 within the high pressure chamber 43, through a communication passage 53 formed through the timer piston 40 and having a small restriction 53*a*. As a consequence, when the timer piston 40 moves from an advance position, wherein the slant peripheral pressure-receiving surface 40*c* is not in abutment with the cylindrical seat member 49, in a direction of retarding the fuel injection timing, i.e. in the leftward direction as viewed in FIG. 3, part of pump chamber pressure Pt leaks from the space 43' of the high pressure chamber 43 through the restriction 53*a* and the communication passage 53 into the low pressure chamber 47, thereby assuring smooth movement of the timer piston 40 without hydraulical locking.

The operation of the timer 4 constructed as above will be explained hereinbelow.

When the distributor-type fuel injection pump is started by the engine, the pump chamber pressure Pt is so low that the timer spring 48 biases the timer piston 40 in the reference position, as shown in FIG. 2. On this occasion, the slant peripheral pressure-receiving surface 40*c* of the timer piston 40 abuts against the seal member 51. Therefore, the total effective pressure receiving area at which the timer piston 40 is acted upon by the pump chamber pressure Pt is the sum a of the area of the central pressure-receiving surface 40*b* and the area of a portion of the slant peripheral pressure-receiving surface 40*c* which is radially inward of the seal member 51.

Thereafter, as the pump rotational speed Np increases, the pump chamber pressure Pt increases. When the pump rotational speed Np reaches the first predetermined value N1, the force of the pump chamber pressure Pt surpasses the force of the timer spring 48 so that the timer piston 40 is caused to move from the reference position shown in FIG. 2 in the direction of advancing the fuel injection timing.

While the timer piston 40 moves by the predetermined amount X from the reference position in FIG. 2, as the pump rotational speed Np increases from the first predetermined value N1 and reaches a second predetermined value N2, which is higher than the first predetermined value N1, the cylindrical seat member 49 is also moved by the predetermined amount X from the reference position in FIG. 2 together with the timer piston 40 with the seal member 51 in urging contact with the slant peripheral surface 40*c*, by the force of the second spring 50. During this movement, the total effective area at which the timer piston 40 is acted upon by the pump chamber pressure Pt is equal to a, as stated above, which is relatively small. As a consequence, when the pump rotational speed Np increases within a low pump speed region, i.e. from the first predetermined value N1 to the second predetermined value N2, the fuel injection timing $T_A$ advances at a smaller rate with respect to the pump rotational speed Np, as shown by the solid line (a) in FIG. 4. In this lower pump speed region, provided that the total advance amount of the fuel injection timing within the lower pump speed region is l1, a unit advance amount Δl1 per a unit increase in the pump rotational speed Np is expressed as:

$$\Delta l1 = a \cdot Pt/(kF - kf)$$

where kF is the spring constant of the timer spring 48, and kf is the spring constant of the second spring 50.

Figure 3:
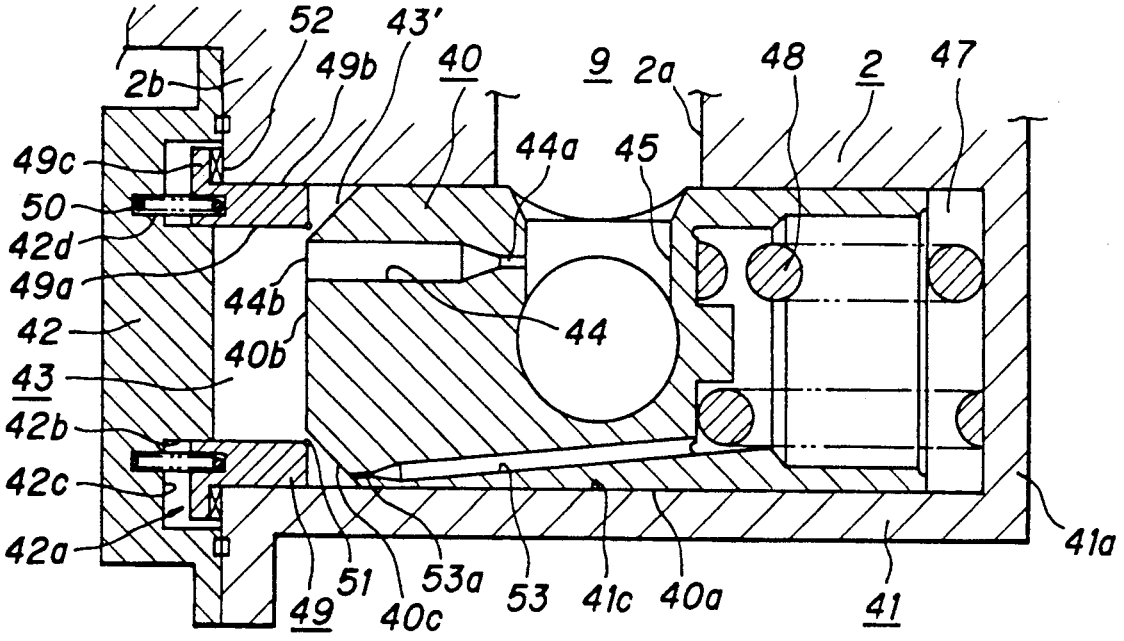
FIG. 3 is a view similar to FIG. 2, wherein the device is in a position in which the pressure receiving area is relatively large.

As the pump rotational speed Np further increases from the second predetermined value N2, the timer piston 40 continues to move in the direction of advancing the fuel injection timing. Then, when the seat member 49 has moved by the predetermined amount X, it is stopped by the stopper 52 and kept in a position which is distant by the predetermined amount X from the reference position, whereby the slant peripheral pressure-receiving surface 40*c* moves away from the annular seal member 51, as shown in FIG. 3. Then, the timer piston 40 is acted upon by the pump chamber pressure Pt at the total effective area which is the sum A of the area of the central pressure-receiving surface 40*b* and the entire area of the slant peripheral pressure-receiving surface 40*c*, and the force of the second spring 50 no longer acts on the timer piston 40. If the area difference (A−a) is set larger than the difference between the force F of the timer spring 48 and the force f of the second spring 50, the timer piston 40 moves to increase the fuel injection timing $T_A$ by a predetermined amount l2, as shown by the solid line (b) in FIG. 4, immediately when the pump rotational speed Np reaches the second predetermined value N2 to bring the slant peripheral pressure-receiving surface 40*c* out of contact with the seal member 51.

Figure 4:
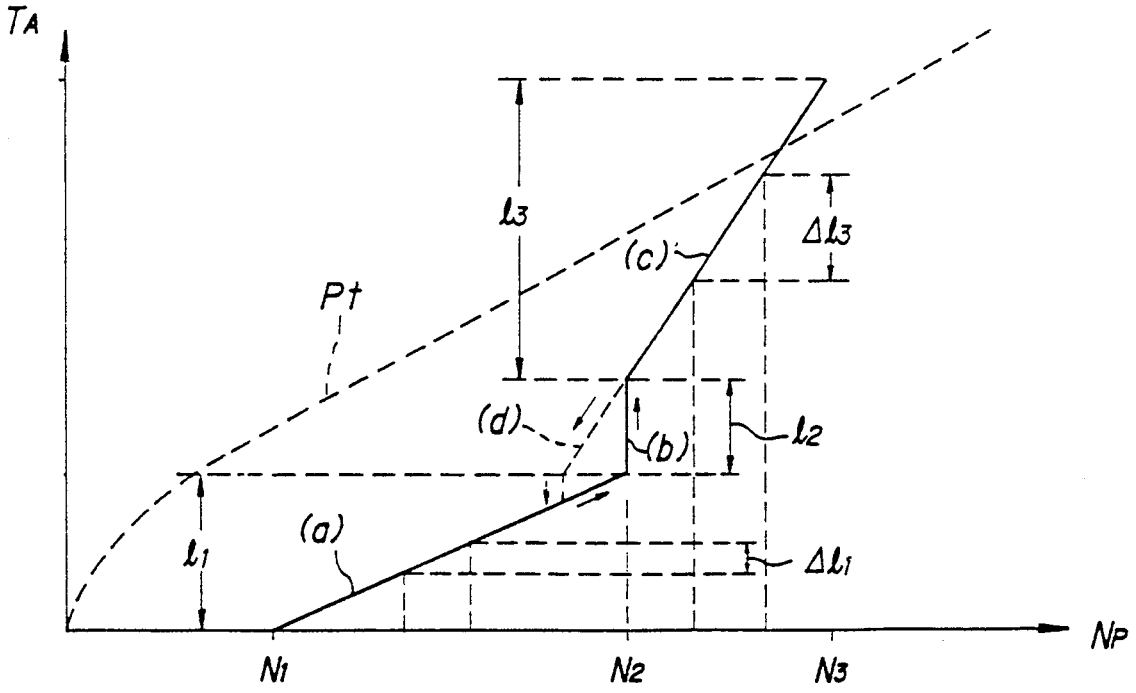
FIG. 4 is a graph showing the relationship between the advance amount $T_A$ of the fuel injection timing and the pump rotational speed Np.

As the pump rotational speed Np further increases within a middle and high pump speed region defined between the second predetermined value N2 and a third predetermined value N3, which is higher than the second predetermined value N2, the fuel injection timing $T_A$ advances with respect to the pump rotational speed Np, at a higher rate, as compared with the low pump speed region, as shown by the solid line (c) in FIG. 4. That is, in the middle and high pump speed region, provided that the total advance amount of fuel injection timing is l3, a unit advance amount Δl3 per a unit increase in the pump rotational speed Np is expressed as:

$$\Delta l3 = A \cdot Pt/kF$$

On the other hand, as the pump rotational speed Np decreases from the third predetermined value N3, the timer piston 40 is caused to return from the maximum advance position in the direction of retarding the fuel injection timing. During this movement of the timer piston 40, even when the pump rotational speed Np decreases to the second predetermined value N2, the slant peripheral pressure-receiving surface 40*c* of the timer piston 40 is still out of contact with the seal member 51 of the cylindrical seat member 49 in the projected position. Consequently, the fuel injection timing $T_A$ continues to decrease along a characteristic line shown by the broken line (d) which is an extension of the characteristic shown by the solid line (c) in FIG. 4, until the timer piston 40 is again brought into contact with the seal member 51. This hysteresis does not exert any substantial influence upon the fuel injection timing control.

As described above, the fuel injection timing $T_A$ is controlled in such a manner that it increases at a lower rate within a low rotational speed region from the first predetermined value N1 to the second predetermined value N2, and at a higher rate within a middle and high rotational speed region from the second predetermined value N2 to the third predetermined value N3, by varying in two steps the pressure-receiving area of one end of the timer piston 40.

According to the above described embodiment, it suffices to machine only the inner peripheral surface 41*c* of the cylinder 41 and the outer peripheral surface 40*a* of the timer piston 40 into oiltight sliding surfaces with close tolerances, and therefore, the machining operation of these parts 40, 41 is much easier than in the manufacture of the conventional device.

Further, in the above described embodiment, when the volume of the high pressure chamber 43 decreases by the movement of the timer piston in the direction of retarding the fuel injection timing, part of the pump chamber pressure Pt within the space 43' of the high pressure chamber 43 is allowed to leak into the low pressure chamber 47 through the small restriction 53*a* and the communication passage 53, whereby the timer piston 40 can smoothly move in the direction of retarding the fuel injection timing without being hydraulically locked.

Furthermore, since the annular seal member 51 is secured by baking to the inner peripheral end edge of the cylindrical seat member 49, the cylindrical seat member 49 can abut against the end of the timer piston 40 in an oiltight manner along the whole circumference thereof without being unevenly or locally urged against part of the periphery of the end of the timer piston 40. Therefore, the use of the resilient seal member 51 enables omission of accurate machining of the end edge of the seat member 49 and the opposed slant peripheral surface 41*c* of the timer piston 40.

In the above described embodiment, the stopper 52 may be formed by a shim which is selected in thickness so as to provide a suitable prestroke X for the cylindrical seat member 49 and hence the timer piston 40.

What is claimed is:

1. An injection timing control device for a distributor-type fuel injection pump, comprising the combination of:

a pump housing defining therein a pump chamber, a cylinder provided on said pump housing, a timer piston slidably received within said cylinder, said timer piston having end faces, a roller holder connected to said timer piston, means for applying pressure within said pump chamber to said timer piston at one end face of said timer piston within said cylinder, first spring means for urging said timer piston at another end face thereof against said pressure, and wherein said timer piston is slidably moved within said cylinder in response to a difference between said pressure within the pump chamber and the force of said first spring means to thereby rotate said roller holder for varying the fuel injection timing;

a movable seat member, said movable seat member having one end thereof disposed for urging contact with said one end face of said timer piston, said one end face of said timer piston having a total effective pressure receiving area at which said pressure acts on upon said timer piston, said total effective pressure receiving area being decreased when said one end of said seat member is in urging contact with said one end face of said timer piston;

second spring means for urging said seat member toward said timer piston; and stopper means associated with said seat member and operable to allow said seat member to be moved by the force of said second spring means toward said timer piston so as to have said one end thereof kept in urging contact with said one end face of said timer piston while said timer piston moves from a first position, in which the fuel injection timing is most retarded, to a second position, in which the fuel injection timing is advanced by a predetermined amount, and to inhibit said seat member from being moved by the force of said second spring means toward said timer piston to bring said one end of said seat member out of contact with said one end face of said timer piston after said timer piston is moved beyond said second position in a direction of further advancing the fuel injection timing, wherein said total effective pressure receiving area is increased when said one end of said seat member is out of contact with said one end face of said timer piston, whereby the fuel injection timing advances at a higher rate with respect to the pump rotational speed.

2. The injection timing control device as claimed in claim 1, wherein said one end face of said timer piston comprises a flat central pressure-receiving surface, and a slant peripheral pressure receiving surface, said seat member comprising a cylindrical member having one end thereof disposed for urging contact with said slant peripheral pressure-receiving surface of said timer piston.

3. The injection timing control device as claimed in claim 2, including an annular seal member secured to said one end of said seat member for urging contact with said slant peripheral pressure-receiving surface of said timer piston.

4. The injection timing control device as claimed in claim 3, wherein said annular seal member is secured by baking to an inner peripheral edge of said one end of said seat member.

5. The injection timing control device as claimed in claim 2, including a passage having a restriction formed through said timer piston and communicating a space defined between said cylinder, said slant peripheral pressure-receiving surface, and said one end of said seat member with a low pressure zone.

6. The injection timing control device as claimed in claim 1, wherein said stopper means comprises a flanged portion formed on said seat member, and an annular stopper arranged at a predetermined location between said flanged portion and said timer piston, said flanged portion being disposed to abut against said annular stopper while said seat member is moved toward said timer piston.

7. The injection timing control device as claimed in claim 6, wherein said annular stopper comprises a shim.

8. In an injection timing control device for a distributor-type fuel injection pump having a pump housing defining therein a pump chamber, a cylinder provided on said pump housing, a timer piston slidably received within said cylinder, said timer piston having end faces, a roller holder connected to said timer piston, means for applying pressure within said pump chamber to said timer piston at one end face of said timer piston within said cylinder, first spring means for urging said timer piston at another end face thereof against said pressure, and wherein said timer piston is slidably moved within said cylinder in response to a difference between said pressure and the force of said first spring means to thereby rotate said roller holder for varying the fuel injection timing, the improvement comprising:

a movable seat member, said movable seat member having one end thereof disposed for urging contact with said one end face of said timer piston, said one end face of said timer piston having a total effective pressure receiving area at which said pressure acts on upon said timer piston, said total effective pressure receiving area being decreased when said one end of said seat member is in urging contact with said one face of said timer piston;

second spring means for urging said seat member toward said timer piston; and stopper means associated with said seat member and operable to allow said seat member to be moved by the force of said second spring means toward said timer piston so as to have said one end thereof kept in urging contact with said one end face of said timer piston while said timer piston moves from a first position, in which the fuel injection timing is most retarded, to a second position, in which the fuel injection timing is advanced by a predetermined amount, and to inhibit said seat member from being moved by the force of said second spring means toward said timer piston to bring said one end of said seat member out of contact with said one end face of said timer piston after said timer piston is moved beyond said second position in a direction of further advancing the fuel injection timing;

said one end face of said timer piston comprising a flat central pressure receiving surface, and a slant peripheral pressure receiving surface; and said seat member comprising a cylinder member having one end thereof disposed for urging contact with said slant peripheral pressure receiving surface of said timer piston.

9. The injection timing control device as claimed in claim 8, including an annular seal member secured to said one end of said seat member for urging contact with said slant peripheral pressure-receiving surface of said timer piston.

10. The injection timing control device as claimed in claim 9, wherein said annular seal member is secured by baking to an inner peripheral edge of said one end of said seat member.

11. In an injection timing control device for a distributor-type fuel injection pump having a pump housing defining therein a pump chamber, a cylinder provided on said pump housing a timer piston slidably received within said cylinder, said timer piston having end faces, a roller holder connected to said timer piston, means for applying pressure within said pump chamber to said timer piston at one end face of said timer piston within said cylinder, first spring means for urging said timer piston at another end face thereof against said pressure, and timer piston is slidably moved within said cylinder in response to a difference between said pressure and the force of said first spring means to thereby rotate said roller holder for varying the fuel injection timing, the improvement comprising:

a movable seat member, said movable seat member having one end thereof disposed for urging contact with said one end face of said timer piston, said one end face of said timer piston having a total effective pressure receiving area at which said pressure acts on upon said timer piston, said total effective pressure receiving area being decreased when said one end of said seat member is in urging contact with said one face of said timer piston;

second spring means for urging said seat member toward said timer piston; and stopper means associated with said seat member and operable to allow said seat member to be moved by the force of said second spring means toward said timer piston so as to have said one end thereof kept in urging contact with said one end face of said timer piston while said timer piston moves from a first position, in which the fuel injection timing is most retarded, to a second position, in which the fuel injection timing is advanced by a predetermined amount, and to inhibit said seat member from being moved by the force of said second spring means toward said timer piston to bring said one end of said seat member out of contact with said one end face of said timer piston after said timer piston is moved beyond said second position in a direction of further advancing the fuel injection timing; and a passage having a restriction formed through said timer piston and communicating a space defined between said cylinder, said slant peripheral pressure-receiving surface, and said one end of said seat member with a low pressure zone.

* * * * *

UNITED STATES PATENT AND TRADEMARK OFFICE

CERTIFICATE OF CORRECTION

PATENT NO. : 5,085,195

DATED : February 4, 1992

INVENTOR(S) : YOSHIZU et al

It is certified that error appears in the above-identified patent and that said Letters Patent is hereby corrected as shown below:

Title page, Section [56] References Cited, under "U.S. Patent Documents":

Change the issue date of U.S. patent "4,333,437" from "6/1983" to --6/1982--.

Signed and Sealed this

Sixth Day of July, 1993

*Attest:*

*Attesting Officer*

Michael K. Kirk

MICHAEL K. KIRK

*Acting Commissioner of Patents and Trademarks*